United States Patent [19]

Pickering et al.

[11] Patent Number: 4,957,094

[45] Date of Patent: Sep. 18, 1990

[54] COMPOUND ARCHERY BOW WITH NON-STRETCH BOWSTRING AND ECCENTRICS FOR SECURING SAME

[75] Inventors: James A. Pickering, Sandy; Joseph R. Johnston, Park City, both of Utah; Thomas A. Fisher, Prescott Valley, Ariz.

[73] Assignee: The Hoyt/Easton Archery Company, Inc., Salt Lake City, Utah

[21] Appl. No.: 125,120

[22] Filed: Nov. 25, 1987

[51] Int. Cl.[5] ..... F14B 5/00

[52] U.S. Cl. ..... 124/24.1; 124/90; 124/23.1; 124/25.6

[58] Field of Search ..... 124/23 R, 24 R, 90, 124/25, DIG. 1

[56] References Cited

U.S. PATENT DOCUMENTS

| | | | |
|---|---|---|---|
| 3,486,495 | 12/1969 | Allen . | |
| 3,841,295 | 10/1974 | Hunter | 124/25.6 |
| 3,851,638 | 12/1974 | Alexander . | |
| 3,958,551 | 5/1976 | Ketchum | 124/25.6 |
| 3,967,609 | 7/1976 | Frydenlund | 124/25.6 |
| 4,201,177 | 5/1980 | Holman et al. | 124/25.6 |
| 4,241,715 | 12/1980 | Jennings . | |
| 4,338,910 | 7/1982 | Darlington | 124/24 R |
| 4,368,718 | 1/1983 | Simonds et al. . | |
| 4,401,097 | 8/1983 | Simonds et al. . | |
| 4,478,203 | 10/1984 | Hayes . | |
| 4,519,374 | 5/1985 | Miller | 124/23 R |
| 4,686,955 | 8/1987 | Larson | 124/23 R |
| 4,702,067 | 10/1987 | Izuta | 124/90 X |

OTHER PUBLICATIONS

*Bow & Arrow Magazine;* Jun. 1985; Precision Shooting Equipment, Inc., Advertisement; p. 5.

*Bow & Arrow Magazine;* Feb. 1983; Lower Photograph; p. 60.

Bear Archery Company, 1983 Catalog; Upper Left Illustration; p. 23.

Instruction Manual, Martin Cheetah DynaBo, Martin Archery, Inc.

Advertisement, Martin Archery, Kam-Act MK-2.

Advertisement, Graham's Custom Bows, DYNA BO.

*Primary Examiner*—Randolph A. Reese

*Assistant Examiner*—J. Russell McBee

*Attorney, Agent, or Firm*—Mallinckrodt & Mallinckrodt

[57] ABSTRACT

A compound bow having improved performance and durability is constructed with buss cables and bowstring made of the same substantially non-stretchable material, a preferred material being a polyethylene fiber material such as that known as "Spectra" material. The buss cables and bowstring each form a continuous length with looped ends. The eccentrics of the bow each provide for the separate direct securement of a looped end of a buss cable and a looped end of a bowstring.

36 Claims, 2 Drawing Sheets

COMPOUND ARCHERY BOW WITH NON-STRETCH BOWSTRING AND ECCENTRICS FOR SECURING SAME

BACKGROUND OF THE INVENTION

1. Field

The invention is in the field of compound archery bows and specifically in the field of eccentrics and stringing of compound bows.

2. State of the Art

Traditional compound archery bows all include a handle section, upper and lower limbs attached to the handle section extending outwardly therefrom, a pair of eccentrics with an upper eccentric thereof rotatably mounted on the outer end of the upper limb and a lower eccentric rotatably mounted on the outer end of the lower limb, and lacing including a first buss cable extending from one limb of the bow across the bow to the eccentric on the opposite limb, a second buss cable extending from the other limb of the bow across the bow to the eccentric on the opposite limb, and a central stretch extending between the eccentrics to form a bowstring.

With most compound bows, the buss cables are made of an aircraft type braided cable which extend from one bow limb to the eccentric on the opposite limb, about the eccentric and from the eccentric toward the other eccentric to form the ends of the central stretch with a bowstring made of a bowstring material such as dacron extending between the ends of the cable and attached thereto by connectors such as those commonly referred to as tear drops. The cables generally pass through a passageway in the eccentric in which they are secured thereto by a set screw and are wrapped partially around the eccentrics on either side of the passageway. The short lengths of cable extending from the eccentrics to connect with the bowstring are commonly referred to as pigtails. The bowstring material used on compound bows, such as the dacron mentioned, will stretch and with a normal length bowstring, may stretch up to about ½ inch under stress.

Bowstrings which are substantially non-stretchable have recently been used with recurve as opposed to traditional compound bows. The non-stretchable bowstring material, sold under the trademark "Fast Flight" by Brownell of Modus, Conn., is made of a polyethylene fiber material sold under the trademark "Spectra" by Allied Fibers, Petersburg, Va., a division of Allied-Signal Inc. The material is very strong and does not substantially stretch and it has been found to increase the performance of the recurve bows on which it is used.

While the "Spectra" string material has been used with recurve bows, it has not been found usable on the traditional compound bows where the bowstring is attached to pigtails as described above, and, in fact, such string material now generally carries a label warning against use on that type of compound bow. The reason for this is that there is a tendency when using "Spectra" bowstring material, particularly if the bow is misfired or is accidentally dry fired, i.e. the string is let go from drawn position without an arrow in place, for the teardrops which secure the bowstring to the pigtails extending from the eccentrics to break off or for the cables themselves to break. In such instance, the broken end of the cable may whip around and strike the bow limb and in some cases severely damage the bow limb.

The reason for this breakage is not known. However, when a bow is fired, the limbs of the bow move rapidly forwardly until they are suddenly stopped by the bowstring reaching its braced position and preventing any further forward movement. This sudden stopping of the limbs puts a large amount of stress on the bowstring, its attachment to the cables and on the cables. A string with some stretch will stretch slightly to absorb the sudden stop of the limbs. It is beleived that the substantially non-stretch nature of the "Spectra" string which does not absorb the shock of the stop in order to lessen the sudden stress on the teardrops or other string connectors or on the cables causes too much stress on the connectors and therefore causes them to break off and create an undesirable situation.

While U.S. Pat. Nos. 4,368,718, 4,401,097 and 4,478,203 show a unique eccentric configuration which includes a hook member on the eccentric over which the bowstring is wrapped and shows a bowstring separate from the buss cables and which is secured directly to the eccentric, such direct separate connection is used so that the special eccentric may be used. The bowstring used is still standard stretchable bowstring material. Further, the buss cables are standard cables secured to the eccentrics in the standard manner with a set screw, or, in U.S. Pat. No. 4,478,203, by means of an anchor member secured to the end of the buss cable. Applicants are not aware of any compound bows with more conventionally shaped eccentrics where the bowstrings are connected directly to the eccentrics separately from the buss cables.

SUMMARY OF THE INVENTION

According to the invention, it has been found that the performance and durability of a compound bow can be improved by using a substantially non-stretching bowstring material such as a "Spectra" material and by making not only the bowstring of such material, but by also making the buss cables of the same material. Such material can be effectively and safely used in a traditional compound bow by providing a bowstring of a continuous length sized to fit from one eccentric to the opposite eccentric and by providing eccentrics with means for securing the ends of the bowstring directly thereto along with means for separately securing the ends of a buss cable directly thereto. The eccentrics used may be of conventional configuration or of any desired special configuration as long as means for securing the bowstring and buss cables directly thereto are additionally provided.

The preferred, substantially non-stretch bowstring material is an ultra high molecular weight polyethylene fiber material known as "Spectra" material from which bowstrings for recurve bows are currently being made. This material may easily be made in a specified length with looped ends. For use with the bows of the invention, bowstrings and buss cables of such material are formed with looped ends and the eccentrics are provided with bosses over which the loops of the bowstring and buss cables may be placed in order to secure the bowstrings thereto.

The compound bow of the invention includes a handle section, upper and lower limbs connected to the handle section, each having a free outer end, an upper eccentric mounted for eccentric rotation on the free outer end of the upper limb, and a lower eccentric mounted for eccentric rotation on the free outer end of the lower limb. A first buss cable made of a substantially non-stretchable material has a looped end attached to the lower limb and extends across the bow with the opposite looped end attached to the upper eccentric. A second buss cable made of the same substantially non-stretchable material has a looped end attached to the upper limb and extends across the bow with the opposite looped end attached to the lower eccentric. A bowstring, again made of the same non-stretchable material, has looped ends attached to the eccentric and extends between the eccentrics. Thus, each of the buss cables and the bowstring are made of the same substantially non-stretchable material and are each a continuous length with looped ends.

The eccentrics used in the bow both have means for receiving and holding the looped end of a buss cable and the looped end of a bowstring. The eccentrics preferably each have a bowstring section with bowstring receiving groove about its periphery and a buss cable section with a buss cable receiving groove about its periphery. Loop receiving bosses are located inwardly from the respective bowstring receiving grooves or the buss cable receiving grooves about which the respective looped ends are placed to secure them to the eccentric. If desired, a plurality of bosses may be located on the eccentric, any one of which may selectively receive the loop of the bowstring to thereby provide a selectable range of drawlengths and draw weights for the bow with a fixed length bowstring.

THE DRAWINGS

In the accompanying drawings, which show the presently preferred embodiments for carrying out the invention in actual practice:

FIG. 1 is a side elevation of a compound bow of the invention;

FIG. 2, a perspective view of one side of one of the eccentrics of the bow of FIG. 1, the side shown being that to which the bowstring is attached and the eccentric being drawn to a larger scale;

FIG. 3, a perspective view of the opposite side of the eccentric of FIG. 2, the side shown being that to which the buss cable is attached;

FIG. 4, a fragmentary rear view taken on the line 4—4 of FIG. 1 but with the central portion of the bow broken away and with the remaining portion drawn to a larger scale;

FIG. 5, a fragmentary vertical section taken on the line 5—5 of FIG. 4;

FIG. 6, a fragmentary vertical section taken on the line 6—6 of FIG. 4;

FIG. 7, a perspective view similar to FIG. 2 of the bowstring side of a second embodiment of an eccentric;

FIG. 8, a similar perspective view of the bowstring side of a third embodiment of an eccentric;

FIG. 9, a similar perspective view of the bowstring side of a fourth embodiment of an eccentric; and FIG. 10, a similar perspective view of the bowstring side of a fifth embodiment of an eccentric.

DETAILED DESCRIPTION OF THE ILLUSTRATED EMBODIMENTS

Figure 1:
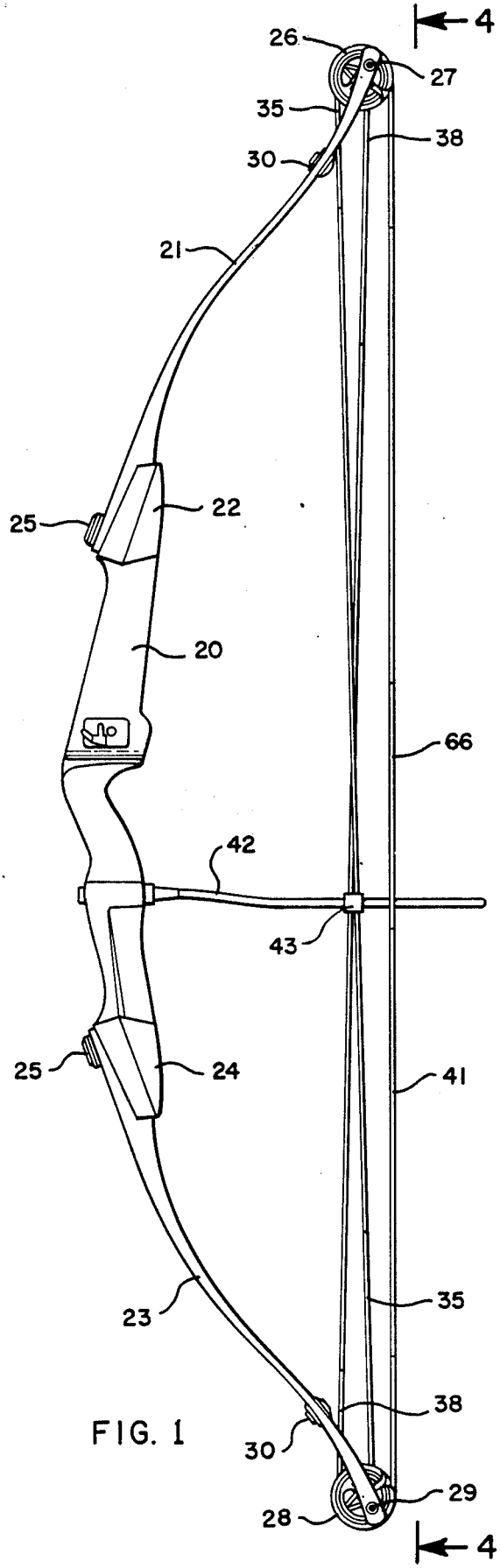

A compound bow is shown in FIG. 1 having a handle section 20 with an upper limb 21 secured to and extending from the upper end 22 thereof and a lower limb 23 secured to and extending from the lower end 24 thereof. The limbs are secured to the handle section by respective limb bolts 25. The outer ends of the limbs are split so that an upper eccentric 26 is pivotally mounted by axle 27 for eccentric rotation at the outer end of upper limb 21 and a lower eccentric 28 is pivotally mounted by axle 29 for eccentric rotation at the outer end of lower limb 23. V groove limb bolts 30 at the inner ends of the limb tip splits or V grooves reinforce the ends of the limbs.

Figure 4:
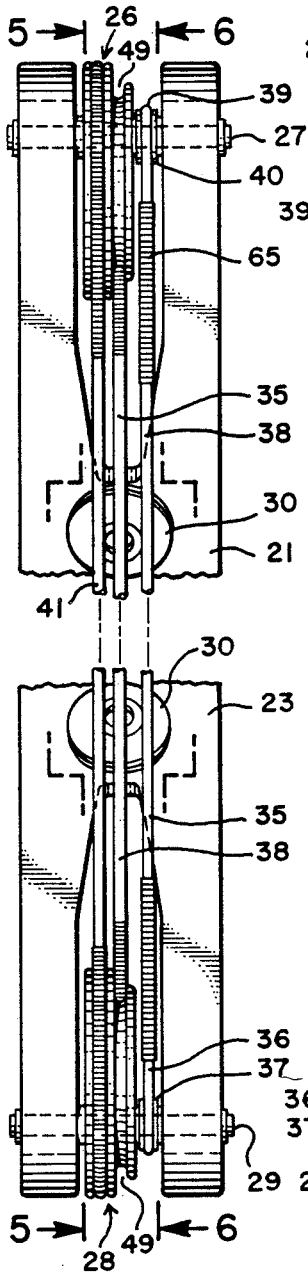
Figure 6:
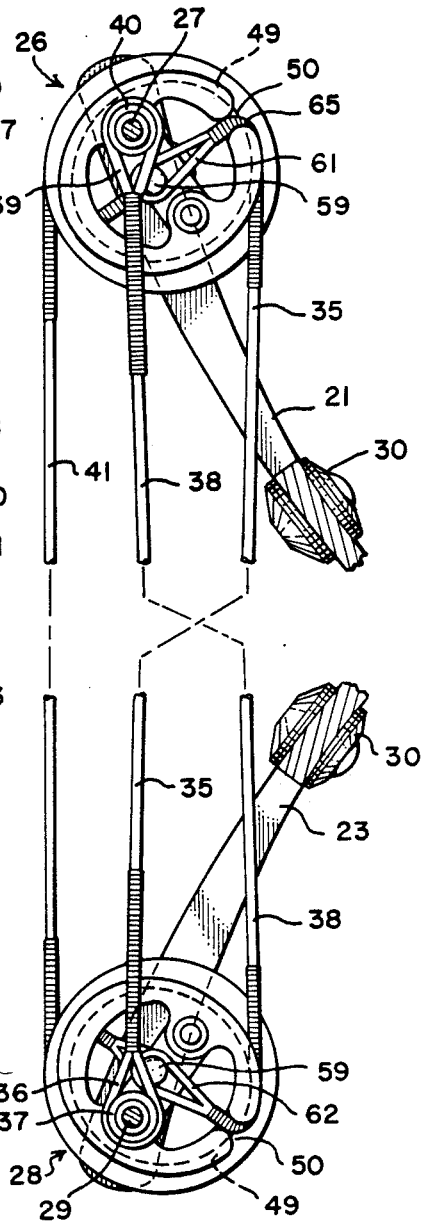

Referring to FIGS. 4 and 6, a buss cable 35, with lower looped end 36, extends from attachment to lower limb 23 around bushing 37 mounted on lower axle 29 adjacent to eccentric 28, to upper eccentric 26. Similarly, a buss cable 38, with upper looped end 39, extends from attachment to upper limb 21 around bushing 40 mounted on upper axle 27 adjacent to eccentric 26, to lower eccentric 28. A bowstring 41 extends between the upper and lower eccentrics. Referring again to FIG. 1, an optional cable glide bar 42 extends from handle 20 rearwardly in normal manner with cable glide block 43 holding buss cables 35 and 38 to offset the cables in normal manner.

The present invention is directed to making the buss cables and bowstring of similar substantially non-stretchable material and to the attachment of the buss cables and bowstring separately directly to the eccentrics. The use of the terminology "buss cable" or "bowstring" is meant only to designate particular parts in the stringing of the bow by generally recognized nomenclature and is not meant to indicate in any way that such parts are made of different material. Also, as is true with most compound bows, the lower eccentric is configured the same as the upper eccentric except that it is mounted for rotation about a different axis. If separate upper and lower eccentrics are made, the placement of the mounting hole will be different for each. In many cases, such as illustrated here, the eccentrics are provided with two mounting holes so the same eccentric can be mounted on either the upper or lower limb. Further, the use of the term "eccentric" in relation to the items pivotally mounted on the limb tips of the bow are not meant to indicate any particular shape for the eccentrics, such eccentric being round in many instances, but merely indicates that such items provide for eccentric movement of the effective point of attachment of the bowstring to the limb tips as in all traditional compound bows.

Figure 2:
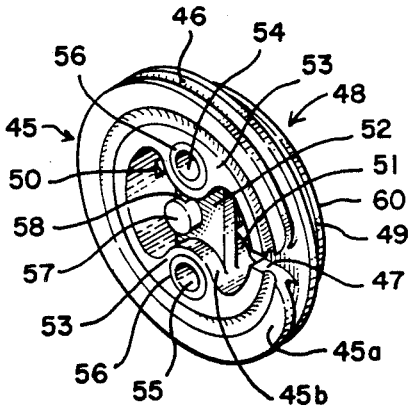
Figure 3:
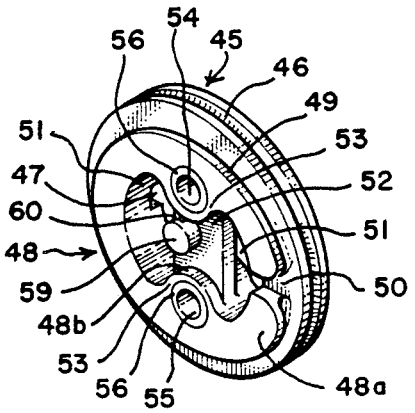

FIGS. 2 and 3 show enlarged perspective views of opposite sides of the presently preferred eccentrics as shown in the bow of FIGS. 1, 4, 5, and 6. Since the upper and lower eccentrics are identical, FIGS. 2 and 3, while showing the eccentrics in the position of upper eccentric 26 of the bow of FIG. 1, also represent lower eccentric 28. FIG. 2 shows the side of the eccentric shown in FIGS. 1 and 5 with the bowstring section, i.e. the side of the eccentric about which the bowstring is wrapped, closest to the viewer. FIG. 3 shows the buss cable section, i.e. the side of the eccentric about which the buss cable is wrapped as shown in FIG. 6, closest to the viewer. As shown in FIGS. 2 and 3, the eccentric has a bowstring section 45 which has a peripheral bowstring receiving groove 46. As shown in this embodiment, the bowstring portion is circular and the peripheral groove extends about its circumference. A passageway in the form of slot 47 extends from the peripheral groove 46 through an outer portion **45*a* of the bowstring section into an inner recessed portion 45*b*** of the bowstring section.

The eccentric also has a buss cable section 48 adjacent bowstring section 45 within a peripheral cable receiving groove 49 thereabout adapted to receive a portion of the buss cable to be secured to the eccentric. As shown, FIGS. 3 and 6, in this embodiment, the buss cable portion is smaller than the bowstring portion and is of an irregular, somewhat eliptical or oval, shape. Also, in this embodiment, the buss cable portion is concentrically arranged with respect to the bowstring portion. A passageway in the form of slot 50 extends from buss cable receiving groove 49 through an outer portion 48*a* of the buss cable section into an inner recessed portion 48*b* of the buss cable section.

As shown, the bowstring section of the eccentric forms one face of the eccentric while the buss cable section forms the other face of the eccentric. The recess in the inner portion of the bowstring section extends inwardly toward the buss cable section from the face of the eccentric formed by the bowstring section. Similarly, the recess in the inner portion of the buss cable section extends inwardly toward the bowstring section. In the embodiment shown, these recesses extend toward one another and meet to form inner open areas 51, but to leave a cross member 52 passing through the center of the recessed portions between open areas 51 and extending between lobes 53. Lobes 53 have bores 54 and 55 with bushings 56 therein. Bore 54 receives axle 27 when the eccentric is mounted on the end of upper limb 21 as the upper eccentric 26 and bore 55 receives axle 29 when the eccentric is mounted on the end of lower limb 23 as lower eccentric 28.

Cross member 52 has a boss 57 projecting outwardly therefrom perpendicularly to the plane of the eccentric. This boss is adapted to receive the looped end of a bowstring with groove 58 on the side of boss 57 opposite slot 47 adapted to receive a portion of the string forming the loop to securely hold it in place about boss 57 when the bowstring is in tension on the bow. A boss 59 extends outwardly from cross member 52 perpendicularly to the plane of the eccentric in the direction of buss cable portion 48 and is adapted to receive the looped end of a buss cable thereabout. A groove 60 in the side of boss 59 opposite slot 50 ensures good securement of the buss cable.

As can be seen, slot 47 leading from the bowstring receiving groove 46 to the inner portion of the eccentric is located 180° about the eccentric from slot 50 leading from buss cable receiving groove 49 to the inner portion of the eccentric. In stringing the bow, and referring to FIGS. 4, 5, and 6, buss cable 35 has one end loop 36 secured to the end of lower limb 23 about bushing 37 and axle 29 as described. The other end of buss cable 35 intersects buss cable receiving groove 49 at its side away from the bowstring as shown in FIGS. 1, 4, and 6 and continues in groove 49 for a short distance until it reaches slot 50. The cable passes through slot 50 and cable end loop 61 is placed about boss 59 to thereby hold buss cable 35 in position and secure it to eccentric 26.

In similar fashion, buss cable 38, secured to upper limb 21 by means of bushing 40 and axle 27 passing through end loop 39, extends to lower eccentric 28 where it intercepts buss cable receiving groove 49 of lower eccentric 28 at its side away from the bowstring as shown in FIGS. 1, 4, and 6. It extends in groove 49 until it reaches slot 50 where it passes through slot 50 to the inner portion of the eccentric and has its end loop 62 positioned around boss 59 thereby securing buss cable 38 to eccentric 28.

Figure 5:
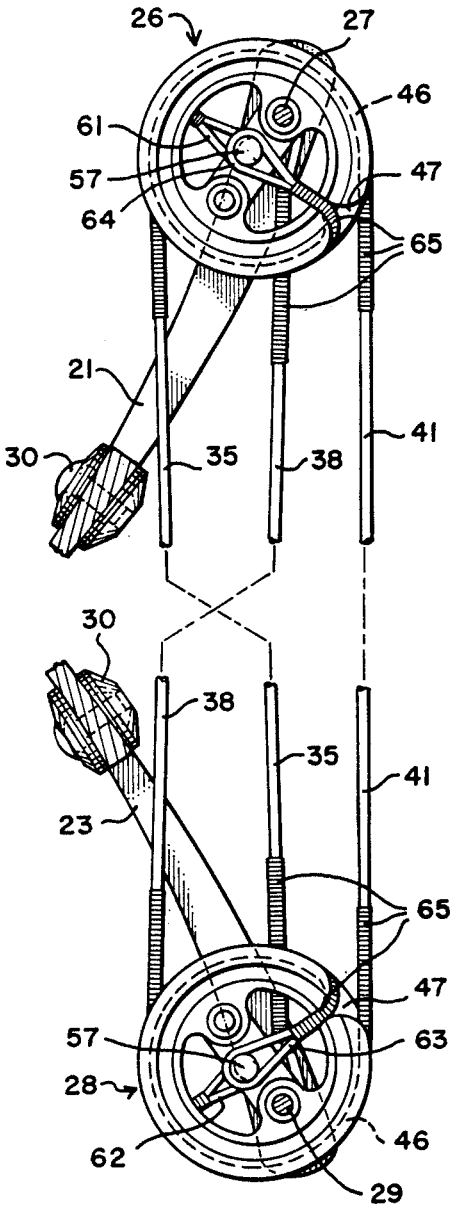

As shown in FIG. 5, an end loop 63 of bowstring 41 is placed about boss 57 of lower eccentric 28. The bowstring 41 extends from boss 57 through slot 47 to bowstring receiving groove 46. The bowstring is wrapped about eccentric 28 through almost 360°, as shown, from where the bowstring leaves receiving groove 46 of lower eccentric 28 and extends to receiving groove 46 of upper eccentric 26, where it is wrapped about eccentric 26 in groove 46 almost 360° until it reaches slot 47. It extends through slot 47 and end loop 64 is placed about boss 57 to secure the string to eccentric 26. As shown in FIGS. 1, 4, 5, and 6, the bow is in its undrawn position. As will be understood by anyone skilled in the art, as the bow is drawn, the necking point of bowstring 41 is moved away from the handle of the bow, i.e. is moved toward the right in FIGS. 1 and 5 and toward the left in FIG. 6. This movement causes eccentrics 26 and 28 to rotate about axles 27 and 29, respectively, thereby causing bowstring 41 to unwind from the eccentrics, i.e. the degree of wrap about the eccentric to lessen, and the buss cables to wind onto the eccentrics, i.e. the degree of wrap about the eccentric to increase. The amount of rotation of the eccentrics will vary somewhat with the configuration and size of the eccentric and draw length of the bow, but will be the same as for any conventionally strung compound bow.

While the bowstring used may be of any type of bowstring material, to obtain full advantage of the mounting system described, it is preferred that the bowstring be made of a substantially non-stretchable material. Bowstrings made of an ultra high molecular weight polyethylene fiber material such as fiber material sold under the trademark "Spectra" by the Allied Fibers division of Allied-Signal Inc., Petersburg, Va. and manufactured into bowstring material by Brownell of Modus, Conn. and sold under the trademark "Fast Flight" have been found ideal. Bowstrings of this material are generally made up of a number of individual strands of "Spectra" material and are made with looped ends. Servings 65 of any suitable material, preferably also a "Spectra" material, are provided at the looped ends of the bow string and buss cables where they pass through the slots in the eccentrics, and a serving 66, FIG. 1, is provided in the area of the bowstring where the nock of the arrow is normally placed. While normal dacron bowstrings may stretch up to about one half inch under stress, and will extend in length over time under stress, thereby affecting the tune of a compound bow over time, the "Fast Flight" strings have substantially no stretch. Further, while the length of dacron bowstrings may vary in manufacture for a given nominal length of up to about three-eights of an inch, the "Fast Flight" strings maintain a manufacturing length tolerance of within about one-sixteenth of an inch. As with various types of bowstrings, the length of the bowstring may be finely adjusted by twisting the bowstring. Such twisting of the bowstring with a recurve bow shortens the string. Such adjustment by twisting the string is not equally effective with compound bows where the bowstring is attached to aircraft type cables because a twisted bowstring will tend to untwist and thereby untwist the cable. Further, it puts a twisting force on the teardrop connectors which is undesirable. With the attachment of the bowstring of the current invention, the bowstring cannot untwist, and twisting of the bowstring to adjust its length has been found very effective.

It has been found that the substantially non-stretchable bowstrings and similar buss cables provide an increase in performance of the bow, and with the mounting system of the present invention, it has been found that the durability and safety of the bow is greatly increased. For example, with a bow as shown in FIG. 1 wherein the buss cables as well as the bowstring were made of the "Fast Flight" "Spectra" string material, it was found that arrow speed increased four to five feet per second over the same bow with conventional aircraft cables and dacron bowstring. In further testing, the bow was drawn 38,000 times with a drawing machine. The bow was then fired by hand 7,800 times. After the drawings and firings, the fistmele, i.e. the distance from the handle to the bowstring, was the same as prior to the drawings and firings of the bow. This indicates that the string and cables had not stretched. After the above number of drawings and firings, the bow was dry fired, i.e. drawn and the string released without shooting an arrow, forty-nine times before the string broke. When the break occured, it was determined that the break was due to a cutting of the string on an edge of one of the eccentrics, not due to a failure of the string or bow. Dry firing should never be done with a bow of conventional stringing because it is very likely to result in a broken string connection, broken string, or broken cable, which can then cause damage to the bow itself.

In another test, a similar bow with conventional aircraft cables and dacron bowstring was drawn about 33,000 times by a drawing machine before the cable broke. The same bow, with the "Spectra" material buss cables and bowstring, was drawn over 103,000 times before testing was stopped and neither the cables nor the string had yet broken.

An advantage of using the "Spectra" string material for the buss cables is that with such material, which generally is made up of a number of strands of the "Spectra" material, it is generally easy to see the wear or any breaks of one or more strands of the material prior to actual failure of the cable or string so that it can be replaced prior to actual failure. With the currently used aircraft cable material, it is very difficult to detect wear of the cable and to know when replacement should be made prior to actual failure.

Figure 7:
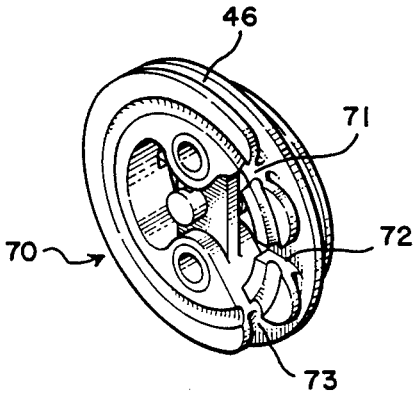

FIG. 7 shows an eccentric 70, similar to eccentric 26, but incorporating the popular tri-draw feature on the bowstring section of the eccentric. Thus, three slots, 71, 72, and 73 are provided intersecting bowstring receiving groove 46. The bowstring can be placed in any one of the three slots in order to change the draw length and draw weight of the bow.

Figure 8:
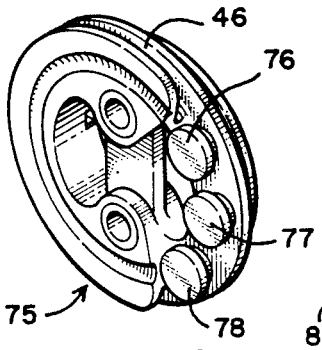

FIG. 8 shows a third embodiment of an eccentric of the invention wherein rather than providing one or more slots intersecting the bowstring receiving groove 46 of the eccentric, one or more bosses are provided about the circumference of the eccentric inwardly of the receiving groove 46 to receive the looped end of the bowstring therearound. The eccentric 75 of FIG. 8 shows three circumferential bosses, 76, 77, and 78, respectively. The looped end of a bowstring may be placed around any one of the three bosses, the particular boss used determining the adjustment of draw length and draw weight of the bow.

Figure 9:
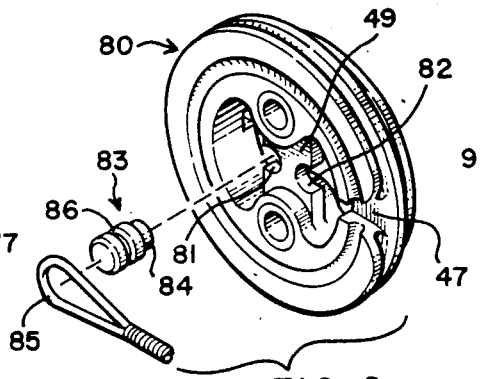

FIG. 9 shows a fourth embodiment of an eccentric of the invention wherein a removable and adjustable boss is provided to adjust the bow. Thus, eccentric 80 is provided with boss receiving holes 81 and 82, respectively, in central member 49. A removable boss 83 has a shank portion 84 adapted to fit into either receiving hole 81 or receiving hole 82. When placed in a receiving hole, the looped end 85 of a bowstring which passes through slot 47 is placed in bowstring receiving groove 86 of boss 83. The particular hole in which boss 83 is fitted will determine the draw length and draw weight adjustment of the bow. While two boss receiving holes are shown, additional holes could be provided to give an additional or increased range of adjustment.

Figure 10:
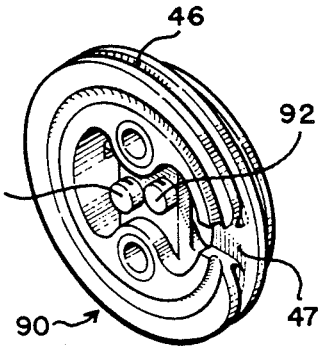

FIG. 10 shows a fifth embodiment of an eccentric of the invention. Here eccentric 90 is provided with a plurality of bosses, here shown as two bosses 91 and 92, in the inner portion of the eccentric. The bowstring would again pass from bowstring receiving groove 46, through slot 47, into the inner portion of the eccentric where the end loop is selectively placed around either boss 91 or 92. The particular boss used will set the draw length and draw weight of the bow.

With each of the embodiments of the eccentrics of FIGS. 7–10, the securement of the buss cable may be non-adjustable and as shown in FIG. 3.

While the eccentrics have all been shown of a particular configuration for both the bowstring section and the buss cable section, the configuration of each may be changed to provide various desired characteristics to the bow. Thus, for example, the buss cable section of the eccentric may be mounted eccentrically with respect to the bowstring section and/or both sections may have similar shape and/or may be of similar size.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. In a compound bow having a handle section, upper and lower limbs connected to the handle section and having free outer ends, and upper and lower eccentrics mounted for eccentric rotation respectively on the free outer ends of the upper and lower limbs, the improvement comprising:

means on each eccentric for receiving a looped end of a bowstring and a looped end of a buss cable to thereby secure such looped ends to the eccentric;

a substantially non-stretchable, continuous bowstring having looped ends, respective looped ends being secured directly to respective eccentrics so that said bowstring extends between the respective eccentics;

a first buss cable made of substantially non-stretchable material and having looped ends, one end being secured directly to the upper eccentric and the other end being secured to the lower limb;

a second buss cable made of substantially non-stretchable material and having looped ends, one end being secured directly to the lower eccentric and the other end being secured to the upper limb;

the points of relative securement of the bowstring and buss cable for each eccentric being such that when the bow is in rest position, the end of the bowstring is wrapped partially about the circumference of the eccentric so that upon drawing the bowstring, the eccentrics rotate to thereby reduce the amount of wrap of the bowstring thereon and to increase the amount of wrap of the end of the buss cable thereon.

2. A compound bow according to claim 1, wherein the bowstring is made of a polyethylene fiber material.

3. A compound bow according to claim 2, wherein the polyethylene fiber material is a material known as Spectra fiber material.

4. A compound bow according to claim 1, wherein the eccentrics both include a bowstring section; a bowstring receiving groove about at least a portion of the periphery of the bowstring section; a buss cable section adjacent the bowstring section; a buss cable receiving groove about at least a portion of the periphery of the buss cable section; means located inwardly from the buss cable receiving groove for securing the looped end of a buss cable to the eccentric so that a portion of the buss cable so secured will rest in the buss cable receiving groove; means located inwardly from the bowstring receiving groove for securing the looped end of a bowstring to the eccentric so that a portion of the bowstring so secured will rest in the bowstring receiving groove; and means in the eccentric for receiving an axle for rotatably mounting the eccentric to the free outer end of a limb of the compound bow.

5. A compound bow according to claim 4, wherein each eccentric has a pair of opposite faces, the bowstring section forming one face of the eccentric and the buss cable portion forming the other face, wherein the bowstring section includes an outer portion and an inner recessed portion, and wherein the buss cable section includes an outer portion and an inner recessed portion, the respective recessed portions being recessed inwardly toward one another from the respective faces of the eccentrics.

6. A compound bow according to claim 5, wherein the inner recessed portions of the bowstring sections of the respective eccentrics and the recessed inner portions of the buss cable sections are recessed toward one another to the extent that they come together at certain locations to form a pair of inner open areas in the eccentric to thereby reduce the mass of the eccentrics and to form a cross member extending across the inner portion of the eccentric between the open areas, wherein there is additionally provided a passageway extending from the bowstring receiving groove to an inner open area to allow a looped end of a bowstring to pass from the bowstring receiving groove into the inner open area and wherein the means for receiving and securing the looped end of the bowstring is located on the cross member.

7. A compound bow according to claim 6, wherein the means for receiving and securing the looped end of the bowstring is a boss extending from the cross member around which the looped end of the bowstring may be placed.

8. A compound bow according to claim 7, wherein the position of the boss on the cross member is selectively adjustable, the position selected determining an adjustment of the draw length and draw weight of the bow.

9. A compound bow according to claim 6, wherein the means for receiving and securing the looped end of the bowstring is a plurality of bosses extending from the cross member, around any one of which the looped end of the bowstring may be selectively placed, the particular boss selected determining an adjustment of the draw length and draw weight for the bow.

10. A compound bow according to claim 6, wherein there are a plurality of passageways extending from the bowstring receiving groove to the inner open area, any one of which may be selected for allowing the looped end of the bowstring to pass from the bowstring receiving groove to the inner open area, the particular passageway selected determining an adjustment of the draw length and draw weight for the bow.

11. A compound bow according to claim 6, wherein a passageway is additionally provided extending from the buss cable receiving groove to the inner open area to allow the looped end of a buss cable to pass from the buss cable receiving groove to the inner open area and wherein the means for receiving and securing the looped end of the buss cable is located on the cross member.

12. A compound bow according to claim 11, wherein the means for receiving and securing the looped end of the buss cable is a boss extending from the cross member around which the looped end of the buss cable is placed.

13. A compound bow according to claim 5, wherein a portion of the outer bowstring section between the bowstring receiving groove and the inner recessed portion is cut away and wherein the means for receiving the looped end of the bowstring and securing it to the eccentric is located in the cut away area.

14. A compound bow according to claim 13, wherein the means for receiving the looped end of the bowstring is a boss extending into the cut away area around which the loop of the bowstring may be placed.

15. A compound bow according to claim 13, wherein the means for receiving and securing the looped end of the bowstring is a plurality of bosses extending into the cut away area and around any one of which the looped end of the bowstring may be selectively placed, the boss selected determining an adjustment of the draw length and draw weight for the bow.

16. A compound bow according to claim 5, wherein the bowstring section of the eccentrics is circular in shape.

17. A compound bow according to claim 16, wherein the buss cable section of the eccentrics is noncircular in shape and is smaller than the bowstring section.

18. A compound bow according to claim 1, wherein the bowstring and buss cables are made of the same material.

19. A compound bow according to claim 18, wherein the bowstring and buss cables are made of a polyethylene fiber material.

20. A compound archery bow comprising a handle section; an upper limb connected at one end to the handle section and extending therefrom and having a free outer opposite end; a lower limb connected at one end to the handle section and extending therefrom in a direction opposite to the upper limb and having a free outer opposite end; an upper eccentric mounted for eccentric rotation on the free outer end of the upper limb and having means thereon for receiving and securing the looped end of a buss cable and the looped end of a bowstring; a lower eccentric mounted for eccentric rotation on the free outer end of the lower limb and having means thereon for receiving and securing the looped end of a buss cable and the looped end of a bowstring; a first buss cable made of a substantially non-stretchable material and having looped ends, one and being secured to the lower limb and the other end being secured to the upper eccentric; a second buss cable made of a substantially non-stretchable material and having looped ends, one end being secured to the upper limb and the other end being secured to the lower eccentric; and a bowstring made of a substantially non-stretchable material and having looped ends, one looped end being secured directly to the upper eccentric and the opposite looped end being secured directly to the lower eccentric, the buss cables and bowstring all being made of the same substantially non-stretchable material and the points of relative attachment of the bowstring and buss cable for each eccentric being such that when the bow is in rest position, the end of the bowstring is wrapped partially about the circumference of the eccentric so that upon drawing the bowstring, the eccentrics rotate to thereby reduce the amount of the bowstring thereon and to increase the amount of wrap of the end of the buss cable thereon.

21. A compound bow according to claim 20, wherein the eccentrics both include a bowstring section; a bowstring receiving groove about at least a portion of the periphery of the bowstring section; a buss cable section adjacent the bowstring section; a buss cable receiving groove about at least a portion of the periphery of the buss cable section; means located inwardly from the buss cable receiving groove for securing an end of a buss cable to the eccentric so that a portion of the buss cable so secured will rest in the buss cable receiving groove; means located inwardly from the bowstring receiving groove for securing an end of a bowstring to the eccentric so that a portion of the bowstring so secured will rest in the bowstring receiving groove; and means in the eccentric for receiving an axle for rotatably mounting the eccentric to the free outer end of a limb of the compound bow.

22. An eccentric for use with a compound bow having a handle section and a pair of limbs extending from the handle section to provide a pair of limb tips, comprising a bowstring section; a bowstring receiving groove about the periphery of the bowstring section; a buss cable section adjacent the bowstring section; a buss cable receiving groove about the periphery of the buss cable section; means located inwardly from the buss cable receiving groove for securing a looped end of a buss cable to the eccentric so that a portion of the buss cable so attached will rest in the buss cable receiving groove; means located inwardly from the bowstring receiving groove for securing a looped end of a bowstring to the eccentric so that a portion of the bowstring so attached will rest in the bowstring receiving groove; and means in the eccentric for receiving an axle for rotatably mounting the eccentric to a limb tip of a compound bow.

23. An eccentric according to claim 22, wherein the eccentric has a pair of opposite faces, the bowstring section forming one face of the eccentric and the buss cable portion forming the other face, wherein the bowstring section includes an outer portion and an inner recessed portion, and wherein the buss cable section includes an outer portion and an inner recessed portion, the respective portions being recessed inwardly toward one another from the respective faces of the eccentrics.

24. An eccentric according to claim 23, wherein the means for securing the looped end of a the bowstring is located in the inner portion of bowstring section.

25. An eccentric according to claim 24, wherein the inner recessed portion of the bowstring section and the recessed inner portion of the buss cable section are recessed toward one another to the extent that they come together at certain locations to form a pair of inner open areas in the eccentric to thereby reduce the mass of the eccentrics and to form a cross member extending across the inner portion of the eccentric between the open areas, wherein there is additionally provided a passageway extending from the bowstring receiving groove to an inner open area to allow a looped end of a bowstring to pass from the bowstring receiving groove into the inner open area and wherein the means for receiving and securing the looped end of the bowstring is located on the cross member.

26. An eccentric according to claim 25, wherein a passageway extends from the buss cable receiving groove to the inner portion of the buss cable section; and wherein the means for securing an end of a buss cable to the eccentric is located in the inner portion of the buss cable section.

27. An eccentric according to claim 26, wherein the means for securing the buss cable is a boss projecting outwardly from the cross member around which a looped end of a buss cable can be placed.

28. An eccentric according to claim 25, wherein the means for receiving a looped end of a bowstring is a boss projecting outwardly from the cross member around which a looped end of a bowstring can be placed.

29. An eccentric according to claim 25, wherein the position of the boss on the cross member is selectively adjustable, the position selected determining an adjustment of the draw length and draw weight of the bow.

30. An eccentric according to claim 25, wherein the means for receiving and securing the looped end of the bowstring is a plurality of bosses extending from the cross member, around any one of which the looped end of the bowstring may be selectively placed, the particular boss selected determining an adjustment of the draw length and draw weight for the bow.

31. An eccentric according to claim 25, wherein the means for receiving a looped end of a bowstring is a boss extending into the cut away area around which a looped end of a bowstring may be placed.

32. An eccentric according to claim 31, wherein the buss cable section is noncircular in shape and is smaller than the bowstring section.

33. An eccentric according to claim 22, wherein a portion of the outer bowstring section between the bowstring receiving groove and the inner recessed portion is cut away and wherein the means for receiving a looped end of a bowstring and securing it to the eccentric is located in the cut away area.

34. An eccentric according to claim 33, wherein the means for receiving and securing the looped end of the bowstring is a plurality of bosses extending into the cut away area and around any one of which the looped end of the bowstring may be selectively placed, the particular boss about which the loop is placed determining the draw length and draw weight of the bow.

35. An eccentric according to claim 22, wherein the bowstring section is circular in shape.

36. An eccentric device for a compound bow, comprising:

(a) a bus cable section, defining a buss cable receiving groove extending about the periphery of said buss cable section of said eccentric device, for receiving a portion of a cable;

(b) first securing means located radially inward of said eccentric device from a portion of said buss cable receiving groove, for fastening a portion of said cable to said eccentric device;

(c) a bowstring section, defining a bowstring receiving groove extending about the periphery of said bowstring section of said eccentric device in a location laterally spaced apart from said buss cable receiving groove, for receiving a portion of a flexible tension-bearing bowstring; and (d) second securing means located radially inward of said eccentric device from a portion of said bowstring receiving groove, for fastening an end portion of said bowstring to said eccentric device, wherein said eccentric device has an axis of rotation defining an axial direction, and at least one of said first and second securing means includes a boss extending axially of said eccentric device, said boss being located within a space at least partly circumscribed by respective parts of one of said buss cable section and said bowstring section.

* * * * *